US012635727B2

(12) United States Patent
Lord et al.

(10) Patent No.: US 12,635,727 B2
(45) Date of Patent: May 26, 2026

(54) SMOKING SUBSTITUTE COMPONENT

(71) Applicant: Imperial Tobacco Limited, Bristol (GB)

(72) Inventors: Chris Lord, Liverpool (GB); Joseph Pemberton, Liverpool (GB); Peter Lomas, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 872 days.

(21) Appl. No.: 17/708,646

(22) Filed: Mar. 30, 2022

(65) Prior Publication Data

US 2022/0218022 A1 Jul. 14, 2022

Related U.S. Application Data

(63) Continuation of application No. PCT/EP2020/077575, filed on Oct. 1, 2020.

(30) Foreign Application Priority Data

Oct. 2, 2019 (EP) ..... 19201000

(51) Int. Cl.

| | |
|---|---|
| ***A24F 40/10*** | (2020.01) |
| ***A24F 40/42*** | (2020.01) |
| ***A24F 40/44*** | (2020.01) |
| ***A24F 40/50*** | (2020.01) |

(52) U.S. Cl.

CPC ..... *A24F 40/10* (2020.01); *A24F 40/42* (2020.01); *A24F 40/44* (2020.01); *A24F 40/50* (2020.01)

(58) Field of Classification Search

None

See application file for complete search history.

(56) References Cited

U.S. PATENT DOCUMENTS

| | | | | |
|---|---|---|---|---|
| 2014/0109921 | A1 | 4/2014 | Chen | |
| 2015/0020822 | A1* | 1/2015 | Janardhan | A61M 15/06 131/328 |
| 2015/0059787 | A1* | 3/2015 | Qiu | A24F 40/46 392/395 |

(Continued)

FOREIGN PATENT DOCUMENTS

| | | | |
|---|---|---|---|
| CN | 203457801 U | * | 3/2014 |
| CN | 103960781 A | | 8/2014 |

(Continued)

OTHER PUBLICATIONS

English translation of FR 3070833 A1 obtained from Espacenet (Year: 2024).*

(Continued)

*Primary Examiner* — Manley L Cummins, IV

(74) *Attorney, Agent, or Firm* — DUNLAP CODDING, P.C.

(57) ABSTRACT

Disclosed is an aerosol-delivery component for an aerosol-generating system (e.g., a smoking substitute system), said component comprising a tank for storing an aerosol precursor and a vaporization chamber housing a vaporizer. The tank being is in fluid communication with the vaporizer. The component further comprises a channel extending from the vaporization chamber to the tank defining an unimpeded air flow pathway from the vaporization chamber into the tank.

14 Claims, 5 Drawing Sheets

(56) References Cited

U.S. PATENT DOCUMENTS

| | | | | |
|---|---|---|---|---|
| 2015/0257449 | A1 | 9/2015 | Gabbay | |
| 2017/0354182 | A1 | 12/2017 | Liu | |
| 2018/0007962 | A1* | 1/2018 | Hunt | A61M 15/06 |
| 2018/0310616 | A1* | 11/2018 | Clemens | A24F 40/40 |
| 2020/0352238 | A1* | 11/2020 | Simpson | A24F 40/44 |
| 2021/0045443 | A1* | 2/2021 | Lord | A24F 40/42 |
| 2021/0093006 | A1* | 4/2021 | Potter | A24F 40/485 |
| 2022/0125106 | A1* | 4/2022 | Potter | A24F 40/485 |

FOREIGN PATENT DOCUMENTS

| | | | | |
|---|---|---|---|---|
| CN | 109 007 980 | A | 12/2018 | |
| FR | 3070833 | A1 * | 3/2019 | A24F 40/485 |
| WO | WO 2016/096497 | A1 | 6/2016 | |
| WO | WO-2016124740 | A1 * | 8/2016 | A61M 11/04 |
| WO | WO 2017/108268 | A1 | 6/2017 | |
| WO | WO-2018057957 | A1 * | 3/2018 | A61M 15/06 |
| WO | WO-2019038521 | A1 * | 2/2019 | A24F 40/53 |

OTHER PUBLICATIONS

International Search Report and Written Opinion (PCT/EP2020/077575), dated Nov. 13, 2020, 14 pages.
International Search Report (19201000.7-1004), dated Apr. 17, 2020, 5 pages.
Office Action regarding Chinese Patent Application No. 202080079929.1, dated Oct. 5, 2024.

* cited by examiner

SMOKING SUBSTITUTE COMPONENT

CROSS-REFERENCE TO RELATED APPLICATIONS/INCORPORATION BY REFERENCE STATEMENT

This application is a non-provisional application claiming benefit to the international application no. PCT/EP2020/077575 filed on Oct. 1, 2020, which claims priority to EP 19201000.7 filed on Oct. 2, 2019. The entire contents of each of the above-referenced applications are hereby incorporated herein by reference in their entirety.

TECHNICAL FIELD

The present disclosure relates to an aerosol-delivery component, which may be a consumable for receipt in an aerosol-delivery device to form an aerosol-delivery system (e.g., a smoking substitute system).

BACKGROUND OF THE DISCLOSURE

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Combustion of organic material such as tobacco is known to produce tar and other potentially harmful by-products. There have been proposed various smoking substitute systems in order to avoid the smoking of tobacco.

Such smoking substitute systems can form part of nicotine replacement therapies aimed at people who wish to stop smoking and overcome a dependence on nicotine.

Smoking substitute systems, which may also be known as electronic nicotine delivery systems, may comprise electronic systems that permit a user to simulate the act of smoking by producing an aerosol, also referred to as a "vapor", which is drawn into the lungs through the mouth (inhaled) and then exhaled. The inhaled aerosol typically bears nicotine and/or flavorings without, or with fewer of, the odor and health risks associated with traditional smoking.

In general, smoking substitute systems are intended to provide a substitute for the rituals of smoking, whilst providing the user with a similar experience and satisfaction to those experienced with traditional smoking and tobacco products.

The popularity and use of smoking substitute systems has grown rapidly in the past few years. Although originally marketed as an aid to assist habitual smokers wishing to quit tobacco smoking, consumers are increasingly viewing smoking substitute systems as desirable lifestyle accessories. Some smoking substitute systems are designed to resemble a traditional cigarette and are cylindrical in form with a mouthpiece at one end. Other smoking substitute systems do not generally resemble a cigarette (for example, the smoking substitute device may have a generally box-like form).

There are a number of different categories of smoking substitute systems, each utilizing a different smoking substitute approach. A smoking substitute approach corresponds to the manner in which the substitute system operates for a user.

One approach for a smoking substitute system is the so-called "vaping" approach, in which a vaporizable liquid, typically referred to (and referred to herein) as "e-liquid", is heated by a heater to produce an aerosol vapor which is inhaled by a user. An e-liquid typically includes a base liquid as well as nicotine and/or flavorings. The resulting vapor therefore typically contains nicotine and/or flavorings. The base liquid may include propylene glycol and/or vegetable glycerin.

A typical vaping smoking substitute system includes a mouthpiece, a power source (typically a battery), a tank or liquid reservoir for containing e-liquid, as well as a heater. In use, electrical energy is supplied from the power source to the heater, which heats the e-liquid to produce an aerosol (or "vapor") which is inhaled by a user through the mouthpiece.

Vaping smoking substitute systems can be configured in a variety of ways. For example, there are "closed system" vaping smoking substitute systems which typically have a heater and a sealed tank which is pre-filled with e-liquid and is not intended to be refilled by an end user. One subset of closed system vaping smoking substitute systems include a device which includes the power source, wherein the device is configured to be physically and electrically coupled to a consumable component including the tank and the heater. In this way, when the tank of the consumable component has been emptied, the device can be reused by connecting it to a new consumable component. Another subset of closed system vaping smoking substitute systems are completely disposable, and intended for one-use only.

There are also "open system" vaping smoking substitute systems which typically have a tank that is configured to be refilled by a user, so the system can be used multiple times.

An example vaping smoking substitute system is the Myblu™ e-cigarette. The Myblu™ e cigarette is a closed system which includes a device and a consumable component. The device and consumable component are physically and electrically coupled together by pushing the consumable component into the device. The device includes a rechargeable battery. The consumable component includes a mouthpiece, a sealed tank which contains e-liquid, as well as a vaporizer, which for this system is a heating filament coiled around a portion of a wick which is partially immersed in the e-liquid. The system is activated when a microprocessor on board the device detects a user inhaling through the mouthpiece. When the system is activated, electrical energy is supplied from the power source to the vaporizer, which heats e-liquid from the tank to produce a vapor which is inhaled by a user through the mouthpiece.

Another example vaping smoking substitute system is the blu PRO™ e-cigarette. The blu PRO™ e cigarette is an open system which includes a device, a (refillable) tank, and a mouthpiece. The device and tank are physically and electrically coupled together by screwing one to the other. The mouthpiece and refillable tank are physically coupled together by screwing one into the other, and detaching the mouthpiece from the refillable tank allows the tank to be refilled with e-liquid. The system is activated by a button on the device. When the system is activated, electrical energy is supplied from the power source to a vaporizer, which heats e-liquid from the tank to produce a vapor which is inhaled by a user through the mouthpiece.

As the vapor passes through the consumable (entrained in the airflow) from the location of vaporization to an outlet of the consumable (e.g., a mouthpiece), the vapor cools and condenses to form an aerosol for inhalation by the user. The aerosol may contain nicotine and/or flavor compounds.

As the e-liquid is vaporized, a negative pressure can build up within the tank. Some equalization of the pressure can occur as a result of the passage of air from the vaporizing chamber through the wick into the tank but this has, in some instances at least, been found to be insufficient such that the subsequent wicking of the e-liquid into the wick is reduced resulting in an unpleasant "dry hit" for the user The present disclosure has been devised in light of the above considerations.

SUMMARY OF THE DISCLOSURE

According to a first aspect there is a provided an aerosol-delivery component for an aerosol-generating system, said component comprising: a tank for storing an aerosol precursor; a vaporization chamber housing a vaporizer, the tank being in fluid communication with the vaporizer, wherein the component further comprises a channel extending from the vaporization chamber to the tank defining an unimpeded air flow pathway from the vaporization chamber into the tank.

An unimpeded air flow pathway between the vaporizing chamber and the tank provides improved equalization of the pressure in the tank compared to the known equalization which proceeds through a passage impeded by the wick.

Optional features will now be set out. These are applicable singly or in any combination with any aspect.

The channel extends between a channel inlet (in the vaporizing chamber) and a channel outlet (in the tank). The channel is unimpeded, i.e., there is a clear line of sight between the channel inlet and the channel outlet.

In some embodiments, the channel is a transverse channel, i.e., it extends transversely within the component.

The component comprises an airflow path that extends from an air inlet to an air outlet. The air outlet is provided in an outlet portion, e.g., an outlet portion of a component housing.

The air outlet/outlet portion may be provided at a first lateral (upper) end of the housing. The housing comprises a base portion at the opposing lateral (lower) end.

The airflow path passes the vaporizer between the air inlet and the air outlet. The vaporizer is housed in the vaporizing chamber.

The airflow path may comprise an inlet portion extending from the air inlet (which may be provided in the lowermost face of the base portion) to the vaporizing chamber, e.g., in a substantially longitudinal direction.

The channel may extend substantially perpendicularly to the inlet portion of the airflow path.

The channel may have a substantially uniform cross-sectional area (transverse to its elongation). It may have a substantially uniform cross-sectional profile.

The airflow path may comprise a vaporizing chamber portion which passes through the vaporizing chamber to an outlet portion.

The vaporizing chamber portion of the airflow path may be bifurcated or may be annular. The vaporizing chamber portion of the airflow path may comprise at least one deflection. For example, the vaporizing chamber portion of the airflow path (through the vaporizing chamber) may comprise a first portion extending longitudinally from the inlet portion of the airflow path towards and downstream of the vaporizer. It may then comprise at least one deflection, e.g., a transverse (e.g., 90 degree) deflection into a transverse second portion. The deflection(s) may be caused by a transverse baffle (e.g., a silicone baffle) provided within the vaporizing chamber and downstream of the vaporizer. The vaporizing chamber airflow path may be bifurcated around the baffle. The vaporizing chamber airflow path may further deflect downstream of the transverse baffle towards the outlet portion of the airflow path.

The outlet portion of the airflow path extends to the air outlet and may be generally longitudinal. The component may comprise a passage extending between the vaporizing chamber and the air outlet, and defining the outlet airflow portion of the airflow path. The channel may extend substantially perpendicularly to the outlet portion of the airflow path/to the passage.

A user may draw air into and along the airflow path by inhaling at the air outlet (i.e., using a mouthpiece portion affixed to or integral with the outlet portion).

References to "downstream" in relation to the airflow path are intended to refer to the direction towards the air outlet/outlet portion. Thus, the vaporizing chamber and outlet portions of the airflow path are downstream of the inlet portion of the airflow path. Conversely, references to "upstream" are intended to refer to the direction towards the air inlet. Thus, the inlet portion of the airflow path (and the air inlet) is upstream of the vaporizing chamber/outlet portions of the airflow path (and the air outlet/outlet portion).

The component comprises a tank for housing an aerosol precursor (e.g., a liquid aerosol precursor). The aerosol precursor may comprise an e-liquid, for example, comprising a base liquid and, e.g., nicotine. The base liquid may include propylene glycol and/or vegetable glycerin. Hence, the component may be a vaping smoking substitute component.

The passage defining the outlet airflow portion may extend from the vaporizing chamber through the tank. The passage may extend longitudinally within the tank and a passage wall may define an inner wall of the tank, e.g., an inner wall of an upper portion of the tank. In this respect, the tank may surround the passage, e.g., the tank may be annular.

As discussed above, the component housing may comprise an outlet portion (with the air outlet) at a first lateral (upper) end and a base portion at the opposing lateral (lower) end.

The housing may further comprise one or more side walls (e.g., laterally opposed first and second side walls) extending longitudinally between the outlet portion and the base portion.

The air inlet may be provided in the base portion.

The housing may further comprise opposing front and rear walls spaced by the laterally opposed first and second side walls. The distance between the first and second side walls of the housing may define a width of the housing. The distance between the front and rear walls may define a depth of the housing. The width of the housing may be greater than the depth of the housing.

The length of the housing may be greater than the width of the housing. The depth of the housing may be smaller than each of the width and the length.

References to "upper", "lower", "above" or "below" are intended to refer to the component when in an upright/vertical orientation, i.e., with elongate (longitudinal/length) axis of the component vertically aligned and with the outlet portion vertically uppermost and the base portion lowermost.

The tank may be defined between the side/front/rear walls of the housing and the passage walls. For example, an upper portion of the tank may be defined between the walls of the housing and the passage walls.

At least a portion of one of the housing walls defining the tank may be translucent or transparent. That is, the tank may comprise a window to allow a user to visually assess the quantity of e-liquid in the tank. The tank may be referred to as a "clearomizer" if it includes a window, or a "cartomizer" if it does not.

As discussed above, the airflow path passes the vaporizer between the air inlet and the air outlet. The vaporizer may comprise a heating element for heating a wick. The vaporizer may be disposed in the vaporizing chamber portion of the airflow path.

The wick may extend across the vaporizing chamber portion of the airflow path. The wick may be oriented so as to extend in a direction between the side walls of the housing, i.e., it may be oriented in the direction of the width (transverse) dimension of the component. Thus, the wick may extend in a direction perpendicular to the direction of airflow in the vaporizing chamber portion of the airflow path.

The channel may extend substantially parallel to the wick. The channel may be vertically/axially spaced from the wick in a downstream direction. The wick may partially define the channel, e.g., a lower wall of the channel.

The vaporizer is disposed in the vaporizing chamber. The vaporizing chamber may form part of the airflow path (i.e., the vaporizing chamber portion of the airflow path).

The vaporizing chamber may be defined by one or more chamber walls. The channel may extend (e.g., transversely) through the chamber walls.

The wick may extend between first and second opposing chamber walls. The first and second chamber walls may separate (i.e., partially separate) the vaporizing chamber from the tank. The first and second chamber walls may each comprise a respective aperture through which a respective end of the wick projects such that the wick is fluid communication with aerosol precursor/e-liquid in the tank. In this way a central portion of the wick may be exposed to air in the (vaporizing chamber portion of the) airflow path and end portions of the wick may be in contact with aerosol precursor/e-liquid stored in the tank. The wick may comprise a porous material. Thus, aerosol precursor may be drawn (e.g., by capillary action) along the wick, from the tank to the exposed portion of the wick.

The channel may be vertically/axially adjacent (in a downstream direction) from one of the apertures in the chamber walls through which the wick extends. The channel may be in fluid communication with the respective aperture.

The wick may have an elongate shape. The wick may be cylindrical. The heating element may be in the form of a filament wound about the wick (e.g., the filament may extend helically about the wick). The filament may be wound about the exposed portion of the wick (i.e., the portion of the wick extending across the airflow path). The heating element may be electrically connectable (or connected) to a power source. Thus, in operation, the power source may supply electricity to (i.e., apply a voltage across) the heating element so as to heat the heating element. This may cause liquid stored in the wick (i.e., drawn from the tank) to be heated so as to form a vapor and become entrained in fluid flowing along the airflow path. This vapor may subsequently cool to form an aerosol in the airflow path (e.g., in the passage defining the outlet portion of the airflow path).

The vaporizing chamber may be defined by an insert (e.g., an insert at least partially formed of silicone) received into an open (e.g., lower) end of the housing. The chamber walls may be walls of the insert. Accordingly, the channel may be at least partially defined by the insert.

The insert may define the base portion of the component. The insert may comprise a lower portion that seals against the walls of the housing so as to define a lower end of the tank. The insert may further comprise an upper portion that cooperates with the lower portion to define the vaporizing chamber.

The upper portion of the insert has a reduced width dimension compared to the lower portion where it seals against the tank such that the tank is partially defined (at a lower portion) between the walls of the housing and the upper portion of the insert. The upper portion of the insert may comprise a bore (e.g., an axial bore) through which the passage defining the outlet portion of the airflow path extends.

The insert comprises two apertures formed in opposing walls of the insert/vaporizing chamber for receipt of respective ends of the wick therethrough. The channel may be defined within and extend (e.g., transversely) through the upper portion of the insert.

The channel may extend along and be partially defined by a lower surface of the upper portion of the insert. For example, an upper wall of the channel may be defined within the lower surface of the upper portion of the insert. The upper wall of the channel may have a substantially semi-cylindrical profile. It may have a diameter of between 3 and 7 mm, e.g., between 4 and 6 mm such as around 5 mm.

In some embodiments, the channel may be defined partly by the lower surface of the upper portion of the insert and partly by the wick.

In some embodiments, the upper portion of the insert comprises at least one longitudinally-extending groove on a surface facing the tank. The outlet of the channel may be provided within the groove.

In a second aspect there is provided an aerosol-delivery system (e.g., a smoking substitute system) comprising a component according to the first aspect and an aerosol-delivery (e.g., smoking substitute) device.

The component may be an aerosol-delivery (e.g., a smoking substitute) consumable, i.e., in some embodiments the component may be a consumable component for engagement with the aerosol-delivery (e.g., a smoking substitute) device to form the aerosol-delivery (e.g., s smoking substitute) system.

The device may be configured to receive the consumable component. For example, the device and the consumable component may be configured to be physically coupled together. For example, the consumable component may be at least partially received in a recess of the device, such that there is snap engagement between the device and the consumable component. Alternatively, the device and the consumable component may be physically coupled together by screwing one onto the other, or through a bayonet fitting.

Thus, the consumable component may comprise one or more engagement portions for engaging with the device. In this way, one end of the consumable component (i.e., the inlet end) may be coupled with the device, while an opposing end (i.e., the outlet end) of the consumable component may define the outlet portion (e.g., for affixing to or comprising a mouthpiece).

The consumable component may comprise an electrical interface for interfacing with a corresponding electrical interface of the device. One or both of the electrical interfaces may include one or more electrical contacts. Thus, when the device is engaged with the consumable component, the electrical interface may be configured to transfer electrical power from the power source to a heating element of the consumable component. The electrical interface may also be used to identify the consumable component from a list of known types. The electrical interface may additionally or alternatively be used to identify when the consumable component is connected to the device.

The device may alternatively or additionally be able to detect information about the consumable component via an RFID reader, a barcode or QR code reader. This interface may be able to identify a characteristic (e.g., a type) of the consumable. In this respect, the consumable component may include any one or more of an RFID chip, a barcode or QR code, or memory within which is an identifier and which can be interrogated via the interface.

In other embodiments, the component may be integrally formed with the aerosol-delivery (e.g., a smoking substitute) device to form the aerosol-delivery (e.g., s smoking substitute) system.

In such embodiments, the aerosol former (e.g., e-liquid) may be replenished by re-filling a tank that is integral with the device (rather than replacing the consumable). Access to the tank (for re-filling of the e-liquid) may be provided via, e.g., an opening to the tank that is sealable with a closure (e.g., a cap).

Further features of the device are described below. These are applicable to both the device for receiving a consumable component and to the device integral with the component.

The device may comprise a power source. The device may comprise a controller.

A memory may be provided and may be operatively connected to the controller. The memory may include non-volatile memory. The memory may include instructions which, when implemented, cause the controller to perform certain tasks or steps of a method. The device may comprise a wireless interface, which may be configured to communicate wirelessly with another device, for example a mobile device, e.g., via Bluetooth®. To this end, the wireless interface could include a Bluetooth® antenna. Other wireless communication interfaces, e.g., WIFI®, are also possible. The wireless interface may also be configured to communicate wirelessly with a remote server.

An airflow (i.e., puff) sensor may be provided that is configured to detect a puff (i.e., inhalation from a user). The airflow sensor may be operatively connected to the controller so as to be able to provide a signal to the controller that is indicative of a puff state (i.e., puffing or not puffing). The airflow sensor may, for example, be in the form of a pressure sensor or an acoustic sensor. The controller may control power supply to a heating element in response to airflow detection by the sensor. The control may be in the form of activation of the heating element in response to a detected airflow. The airflow sensor may form part of the device.

In a third aspect there is provided a method of using the aerosol-delivery (e.g., smoking substitute) consumable component according to the first aspect, the method comprising engaging the consumable component with an aerosol-delivery (e.g., smoking substitute) device (as described above) having a power source so as to electrically connect the power source to the consumable component (i.e., to the vaporizer of the consumable component).

The disclosure includes the combination of the aspects and preferred features described except where such a combination is clearly impermissible or expressly avoided.

BRIEF DESCRIPTION OF THE DRAWINGS

So that further aspects and features thereof may be appreciated, embodiments will now be discussed in further detail with reference to the accompanying figures, in which.

DETAILED DESCRIPTION OF THE DISCLOSURE

Aspects and embodiments will now be discussed with reference to the accompanying figures. Further aspects and embodiments will be apparent to those skilled in the art.

Figure 1A:
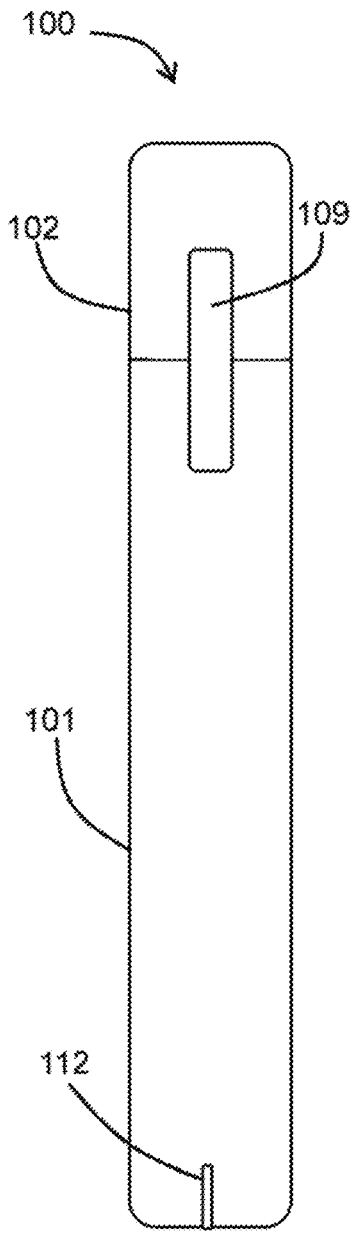
FIG. 1A is a front schematic view of a smoking substitute system.

FIG. 1A shows a smoking substitute system 100. In this example, the smoking substitute system 100 includes a device 101 and an aerosol delivery consumable component 102. The consumable component 102 may alternatively be referred to as a "pod", "cartridge" or "cartomizer". It should be appreciated that in other examples (i.e., open systems), the device may be integral with the component. In such systems, a tank of the aerosol delivery component may be accessible for refilling the system.

Figure 1B:
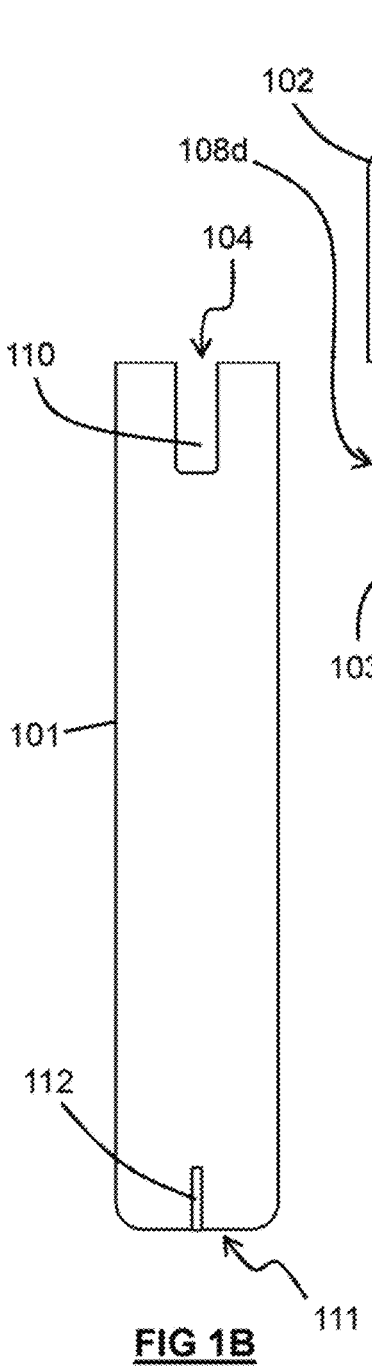
FIG. 1B is a front schematic view of a device of the system.
Figure 1C:
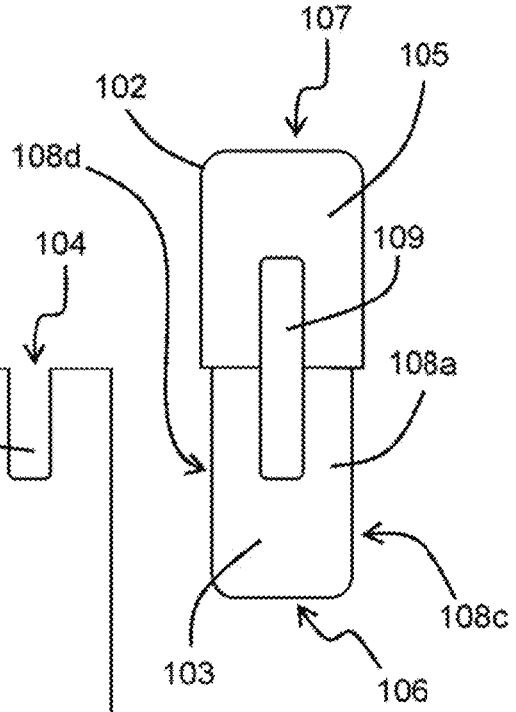
FIG. 1C is a front schematic view of a consumable of the system.

In this example, the smoking substitute system 100 is a closed system vaping system, wherein the consumable component 102 includes a sealed tank 103 and is intended for single-use only. The consumable component 102 is removably engageable with the device 101 (i.e., for removal and replacement). FIG. 1A shows the smoking substitute system 100 with the device 101 physically coupled to the consumable component 102, FIG. 1B shows the device 101 of the smoking substitute system 100 without the consumable component 102, and FIG. 1C shows the consumable component 102 of the smoking substitute system 100 without the device 101.

The device 101 and the consumable component 102 are configured to be physically coupled together by pushing the consumable component 102 into a cavity at an upper end 104 of the device 101, such that there is an interference fit between the device 101 and the consumable component 102. In other examples, the device 101 and the consumable component 102 may be coupled by screwing one onto the other, or through a bayonet fitting.

The consumable component 102 comprises a housing 105 having a base portion 106 (at a lower end), an outlet portion 107 (at an upper end), and walls extending longitudinally from the base portion 106 to the outlet portion 107. In particular, the consumable component 102 comprises front 108*a* and rear walls spaced by opposing first 108*c* and second 108*d* side walls. The distance between the front 108*a* and rear 108*b* walls defines a depth of the housing 105 and the distance between the side walls 108*c*, 108*d* defines a width of the housing 105. The width of the housing 105 is greater than the depth of the housing 105.

The tank 103 of the consumable component 102 comprises a window 109, which allows the quantity of e-liquid remaining in the tank 103 to be visually assessed. The device 101 includes a slot 110 so that the window 109 of the consumable component 102 can be seen whilst the rest of the tank 103 is obscured from view when the consumable component 102 is inserted into the cavity at the upper end 108 of the device 101.

A lower end 111 of the device 101 includes a light 112 (e.g., an LED) located behind a small translucent cover. The light 112 may be configured to illuminate when the smoking substitute system 100 is activated. Whilst not shown, the consumable component 102 may identify itself to the device 101, via an electrical interface, RFID chip, or barcode.

Figure 2A:
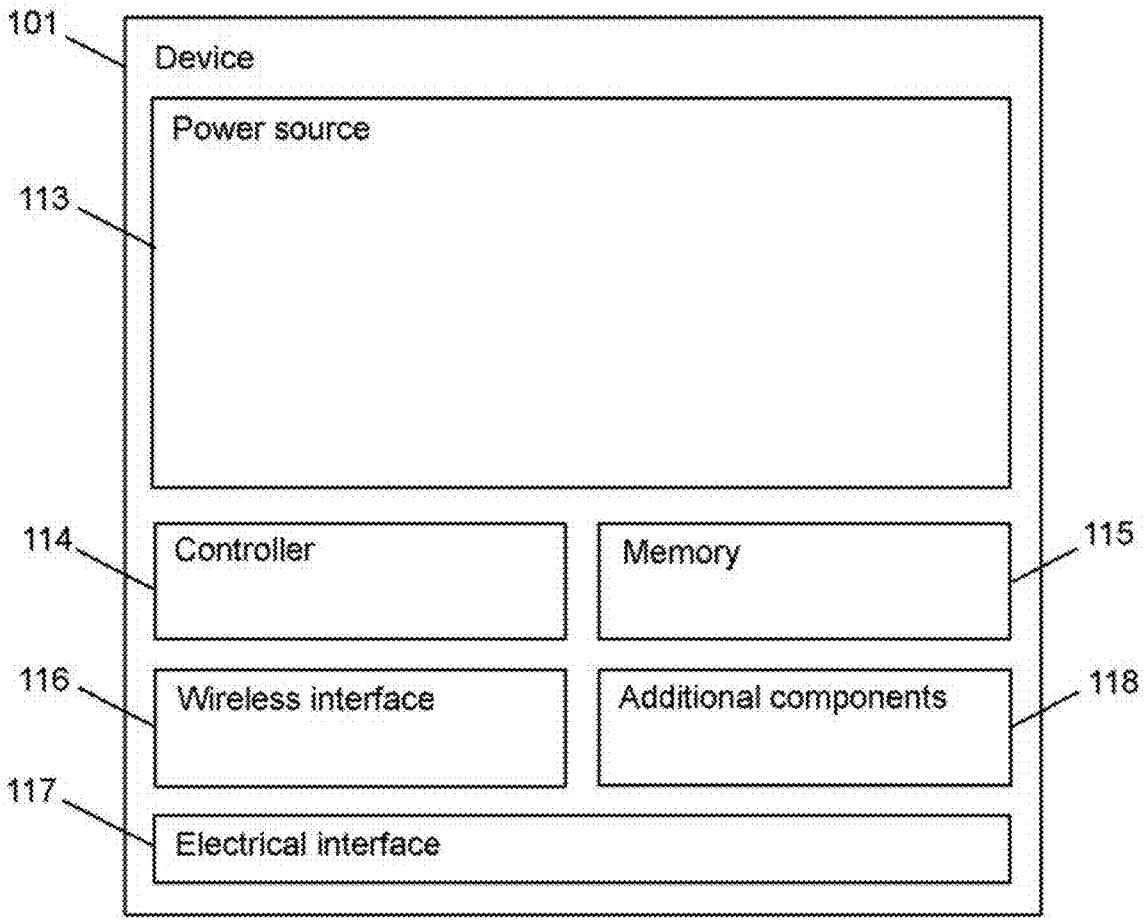
FIG. 2A is a schematic of the components of the device.
Figure 2B:
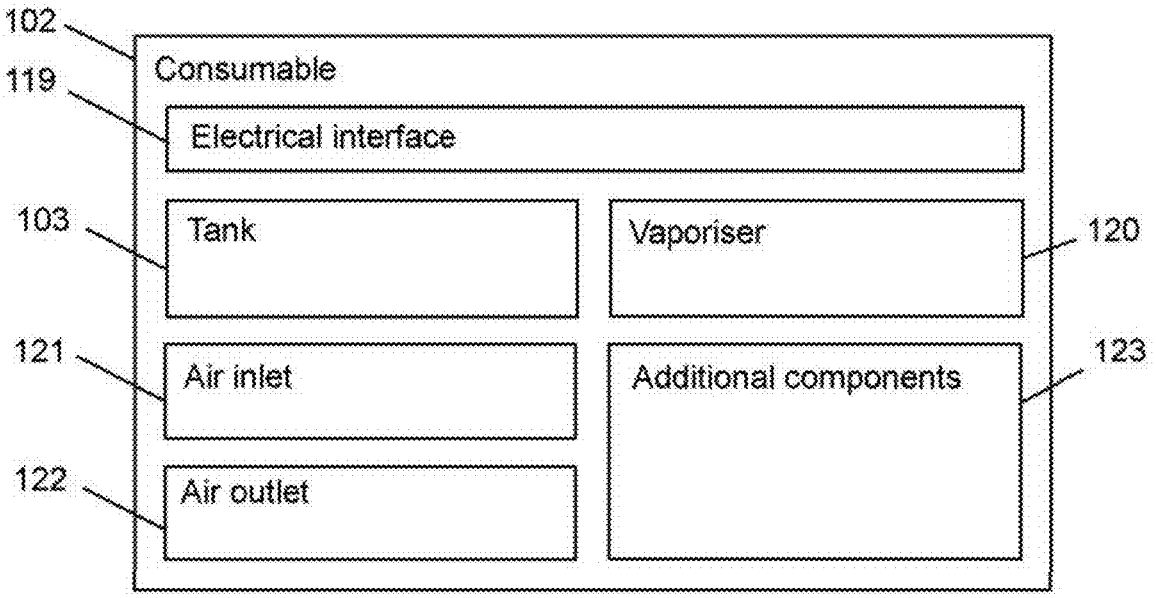
FIG. 2B is a schematic of the components of the consumable.

FIGS. 2A and 2B are schematic drawings of the device 101 and consumable component 102. These figures provide an overview of the components that form part of the consumable component 102 and device 101. As is apparent from FIG. 2A, the device 101 includes a power source 113, a controller 114, a memory 115, a wireless interface 116, an electrical interface 117, and, optionally, one or more additional components 118.

The power source 113 is a battery (e.g., a rechargeable battery). The controller 114 may, for example, include a microprocessor. The memory 115 may include non-volatile memory. The memory 115 may include instructions which, when implemented, cause the controller 114 to perform certain tasks or steps of a method.

The wireless interface 116 may be configured to communicate wirelessly with another device, for example a mobile device, e.g., via Bluetooth®. To this end, the wireless interface 116 could include a Bluetooth® antenna. Other wireless communication interfaces, e.g., WiFi®, are also possible. The wireless interface 116 may also be configured to communicate wirelessly with a remote server.

The electrical interface 117 of the device 101 may include one or more electrical contacts. The electrical interface 117 may be located in a base of the cavity formed in the upper end 104 of the device 101. When the device 101 is physically coupled to the consumable component 102, the electrical interface 117 of the device 101 is configured to transfer electrical power from the power source 113 to the consumable component 102 (i.e., upon activation of the smoking substitute system 100).

The electrical interface 117 may be configured to receive power from a charging station when the device 101 is not physically coupled to the consumable component 102 and is instead coupled to the charging station. The electrical interface 117 may also be used to identify the consumable component 102 from a list of known consumables. For example, the consumable component 102 may include e-liquid having a particular flavor and/or having a certain concentration of nicotine (which may be identified by the electrical interface 117). This can be indicated to the controller 114 of the device 101 when the consumable component 102 is connected to the device 101. Additionally, or alternatively, there may be a separate communication interface provided in the device 101 and a corresponding communication interface in the consumable component 102 such that, when connected, the consumable component 102 can identify itself to the device 101.

The additional components 118 of the device 101 may comprise an indicator (e.g., the light 112 discussed above), a charging portion, a battery charging control circuit, a sensor or, e.g., user input.

The charging port (e.g., USB or micro-USB port) may be configured to receive power from the charging station (i.e., when the power source 118 is a rechargeable battery). This may be located at the lower end 111 of the device 101. Alternatively, the electrical interface 117 discussed above may be configured to act as a charging port configured to receive power from the charging station such that a separate charging port is not required.

The battery charging control circuit may be configured for controlling the charging of the rechargeable battery. However, a battery charging control circuit could equally be located in the charging station (if present).

The sensor may be, e.g., an airflow (i.e., puff) sensor for detecting airflow in the smoking substitute system 100, e.g., caused by a user inhaling through a mouthpiece attachment (not shown) fitted to the outlet portion 107 of the consumable component 102. The smoking substitute system 100 may be configured to be activated when airflow is detected by the airflow sensor. This sensor could alternatively be included in the consumable component 102. The airflow sensor can be used to determine, for example, how heavily a user draws on the outlet portion 107 (through the affixed or integral mouthpiece) or how many times a user draws on the outlet portion 107 in a particular time period.

The user input may be a button. The smoking substitute system 100 may be configured to be activated when a user interacts with the user input (e.g., presses the button). This provides an alternative to the airflow sensor as a mechanism for activating the smoking substitute system 100.

The consumable component 102, which is shown in FIG. 2B, includes the tank 103, an electrical interface 119, a vaporizer 120, an air inlet 121, an air outlet 122 (e.g., formed in the outlet portion 107), and one or more additional components 123.

The electrical interface 119 of the consumable component 102 may include one or more electrical contacts. The electrical interface 117 of the device 101 and the electrical interface 119 of the consumable component 102 may be configured to contact each other and thereby electrically couple the device 101 to the consumable component 102 when the base portion 106 of the consumable component 102 is inserted into the cavity formed in the upper end 104 of the device 101 (as shown in FIG. 1A). In this way, electrical energy (e.g., in the form of an electrical current) is able to be supplied from the power source 113 in the device 101 to the vaporizer 120 in the consumable component 102.

The vaporizer 120 is configured to heat and vaporize e-liquid contained in the tank 103 using electrical energy supplied from the power source 113. As will be described further below, the vaporizer 120 heats the e-liquid received from the tank 103 to vaporize the e-liquid. The air inlet 121 is configured to allow air to be drawn into the smoking substitute system 100 when a user inhales using the air outlet 122 formed in the outlet portion 107, such that the vaporized e-liquid is drawn through the consumable component 102 for inhalation by the user.

In operation, a user activates the smoking substitute system 100, e.g., through interaction with a user input forming part of the device 101 or by inhaling through the air outlet 122 as described above. Upon activation, the controller 114 may supply electrical energy from the power source 113 to the vaporizer 120 (via electrical interfaces 117, 119), which may cause the vaporizer 120 to heat e-liquid drawn from the tank 103 to produce a vapor which is inhaled by a user through the mouthpiece which is affixed to or integral with the outlet portion 107.

An example of one of the one or more additional components 123 of the consumable component 102 is an interface for obtaining an identifier of the consumable component 102. As discussed above, this interface may be, for example, an RFID reader, a barcode, a QR code reader, or an electronic interface which is able to identify the consumable component 102. The consumable component 102 may, therefore include any one or more of an RFID chip, a barcode or QR code, or memory within which is an identifier and which can be interrogated via the electronic interface 117 in the device 101.

It should be appreciated that the smoking substitute system 100 shown in FIGS. 1A to 2B is just one exemplary implementation of a smoking substitute system 100. For example, the system could otherwise be in the form of an entirely disposable (single-use) system or an open system in which the tank is refillable (rather than replaceable).

Figure 3:
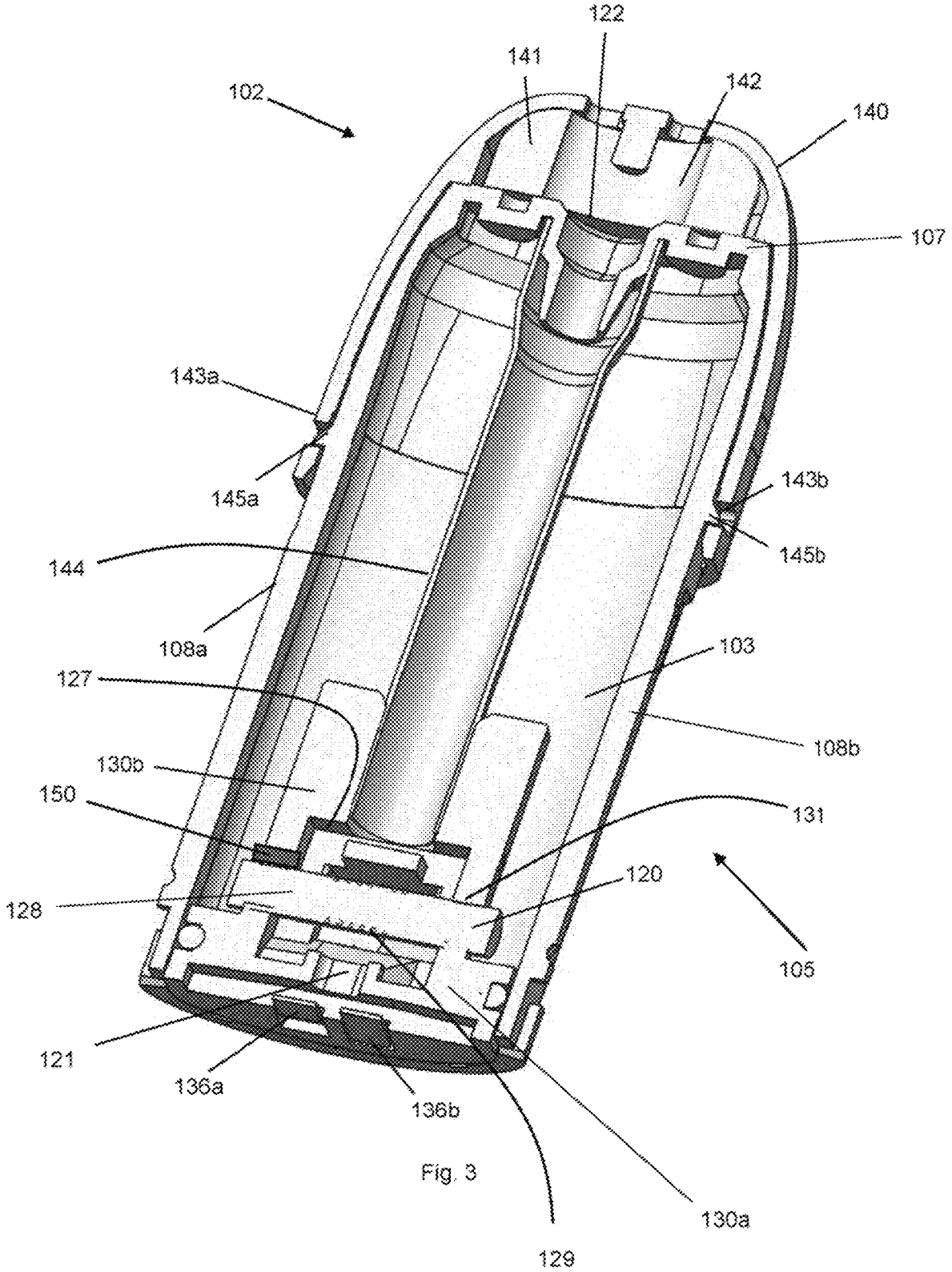
FIG. 3 is a perspective section view of the consumable component.
Figure 4:
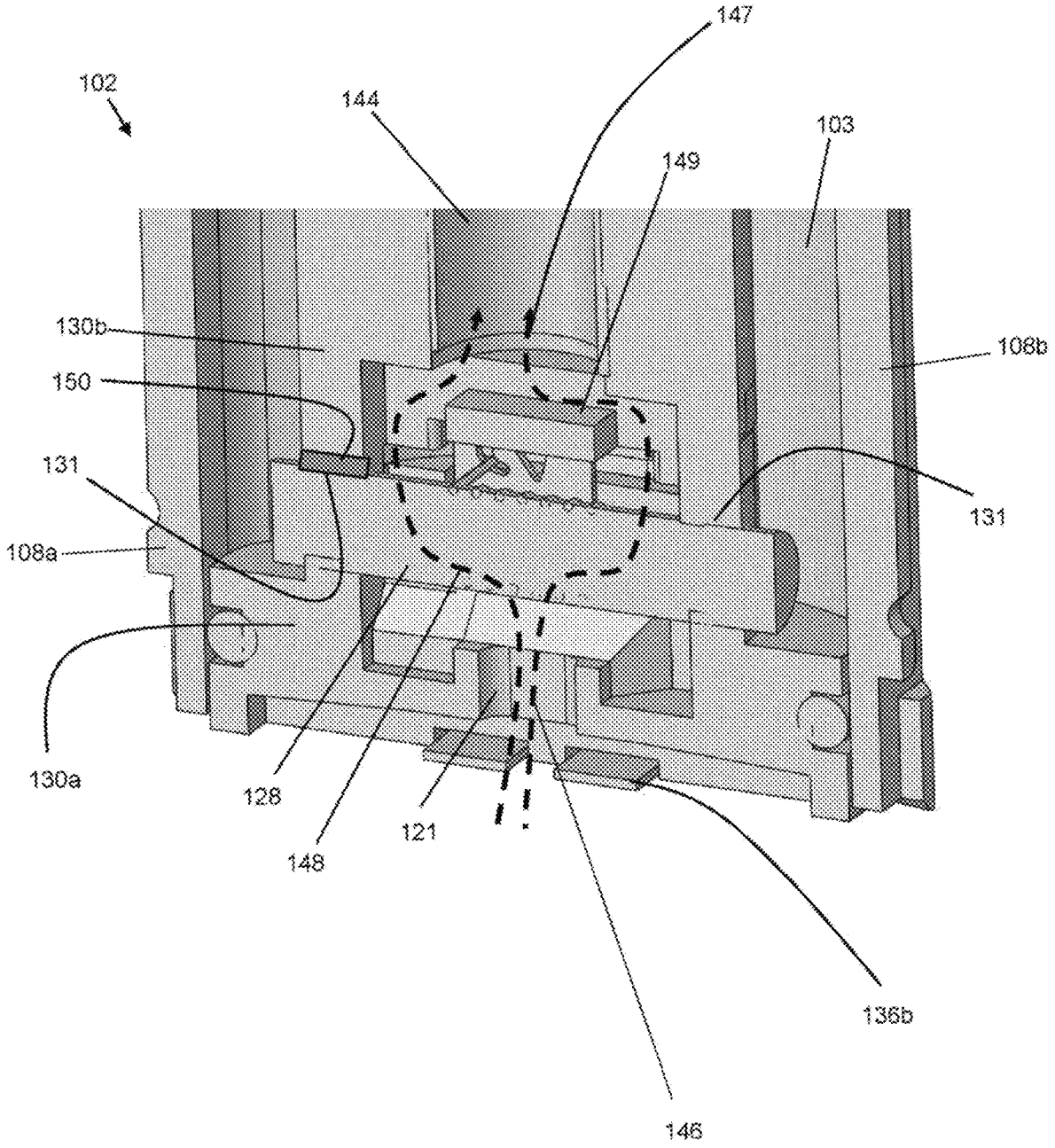
FIG. 4 shows a perspective cross-sectional view of a lower portion of the component.

FIG. 3 is a perspective section view of the consumable component 102 and FIG. 4 shows a perspective cross-sectional view of a lower portion of the component 102.

An air inlet 121 of the consumable component 102 is in the form of an aperture formed in a lower portion 130*a* of an insert 130 which forms the base portion of the housing 105. The lower portion 130*a* of the insert 130 seals against opposing side walls 108*a*, 108*b* of the housing 105 and defines the base of the tank 103 which contains an e-liquid.

The component comprises an airflow path extending from the air inlet 121 to an air outlet 122 formed in the outlet portion 107, such that a user can draw air through the airflow path by inhaling through the air outlet 122 via a mouthpiece portion 140.

The airflow path comprises an inlet portion 146 extending from the air inlet 121 to a vaporizing chamber 127. The vaporizer 120 is located in the vaporizing chamber 127 and comprises a porous wick 128 and a heater filament 129 coiled around the porous wick 128. The wick 128 extends across the vaporizing chamber 127 (perpendicular to the direction of airflow through the chamber 127). That is, the wick 128 extends in the width direction of the housing 105.

The airflow path comprises a vaporizing chamber portion 148 which extends through the vaporizing chamber 127 from the inlet portion 146 to an outlet portion 147 of the airflow path. The outlet portion 147 is defined within a passage 144 which extends generally longitudinally and axially within the component 102.

The vaporizing chamber portion 148 of the airflow path extends through the wick 128 and bifurcates to deflect around a transverse baffle 149

The insert 130 further comprises an upper portion 130*b* which has a reduced width compared to the lower portion 130*a* such that a lower portion of the tank 103 is defined by the housing walls 108*a*, 108*b* and the upper portion 130*b* of the insert 130. The upper portion 130*b* of the insert surrounds the passage 144 and cooperates with the lower portion 130*a* of the insert to define the vaporizing chamber 127.

The insert 130 comprises two apertures 131 formed in opposing walls of the insert 130 for receipt of respective ends of the wick 128 therethrough. The ends of the wick 128 projecting through the apertures 131 in the insert 130 are in contact with aerosol precursor (e-liquid) stored in the tank 103. This e-liquid is transported along the wick 128 (e.g., by capillary action) to a central portion of the wick 128 that is exposed to airflow flowing through the vaporizing chamber 127. The transported e-liquid is heated by the heater filament 129 (when activated, e.g., by detection of inhalation), which causes the e-liquid to be vaporized and to be entrained in air flowing across the wick 128. This vaporized liquid may cool to form an aerosol in the passage 144, which may then be inhaled by a user through the mouthpiece portion 140.

The insert 130 also accommodates the electrical interface 119 of the consumable component 102. The electrical interface 119 comprises two electrical contacts 136*a*, 136*b* that are electrically connected to the heating filament 129. In this way, when the consumable component 102 is engaged with the device 101, power can be supplied from the power source 113 of the device to the heating filament 129.

The component 102 further comprises a mouthpiece portion 140 mounted on the outlet portion 107. Space between the mouthpiece portion 140 and the outlet portion 107 houses an annular filter element 141 having a through bore 142 through which a user can inhale.

The mouthpiece portion 140 comprises opposing apertures 143*a*, 143*b* that form a snap fit engagement with corresponding lugs 145*a*, 145*b* provided on the housing side walls 108*a*, 108*b*.

Figure 5:
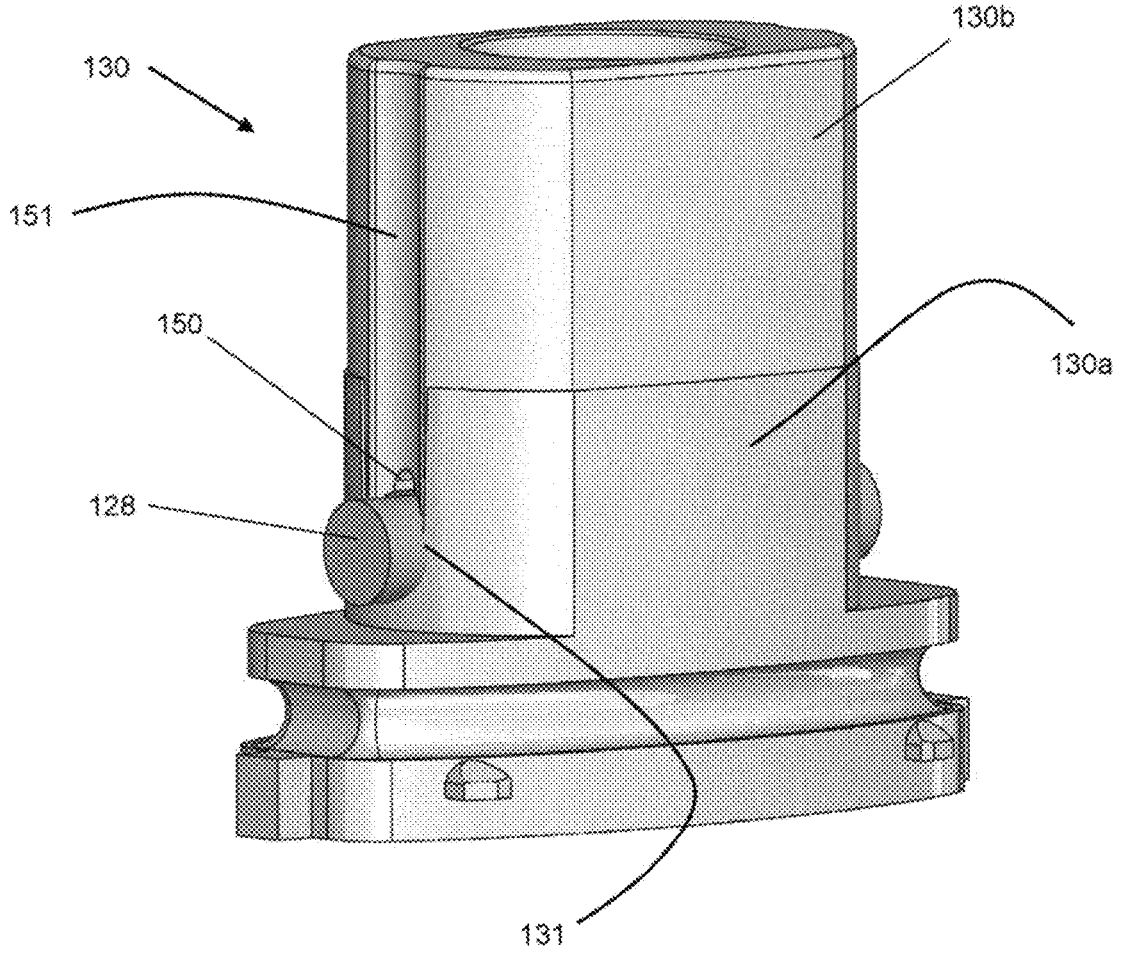
FIG. 5 is a perspective view of the insert of the component.
Figure 6:
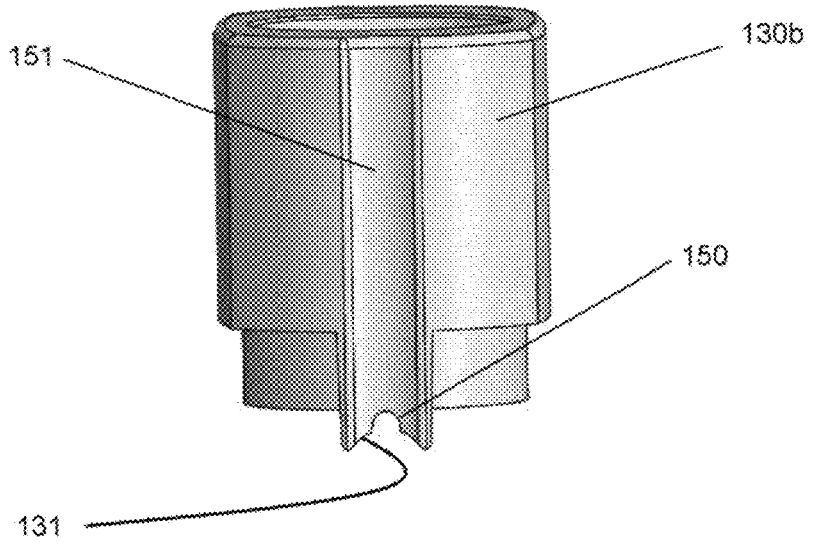
FIG. 6 is a side view of the insert of the component.

The insert 130 is shown in more detail in FIGS. 5 and 6.

As e-liquid is vaporized from the wick 128, the e-liquid in the tank 103 is depleted and a negative pressure can form in the tank which limits further wicking of the e-liquid. The insert 130 defines a transverse channel 150 which extends parallel to and adjacent to the wick 128. The upper wall of the channel 150 is defined by the lower surface of the upper portion 130*b* of the insert 130. The upper wall is substantially semi-cylindrical with a diameter of around 5 mm. The lower wall of the channel 150 is defined by the wick 128. There is a clear, unimpeded passage through the channel 150 such that air can pass freely from the vaporizing chamber 127 to the tank 103 through the channel to equalize the pressure and thus allow continued, consistent wicking of the e-liquid. The channel 150 opens into the tank 103 within a longitudinally extending groove 151 provided on the upper portion 130*b* of the insert 130.

While exemplary embodiments have been described above, many equivalent modifications and variations will be apparent to those skilled in the art when given this disclosure. Accordingly, the exemplary embodiments set forth above are considered to be illustrative and not limiting.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

The invention claimed is:

1. An aerosol-delivery component for an aerosol-generating system, said aerosol-delivery component comprising:

a tank for storing an aerosol precursor;

a vaporization chamber housing a vaporizer comprising a cylindrical wick having a first diameter, the tank being in fluid communication with the vaporizer, wherein the cylindrical wick extends between first and second opposing chamber walls of an insert at least partially formed of silicone defining the vaporization chamber, the first and second opposing chamber walls each comprising a respective aperture through which a respective end of the cylindrical wick projects such that the cylindrical wick is in fluid communication with aerosol precursor in the tank, and wherein the aerosol-delivery component further comprises a channel extending from the vaporization chamber to the tank defining an unimpeded air flow channel pathway from the vaporization chamber into the tank, wherein the cylindrical wick partially defines the channel and the channel comprises a semi-cylindrical profile having a second diameter which is less than the first diameter of the cylindrical wick such that the unimpeded air flow channel pathway cannot be impeded by the cylindrical wick.

2. The aerosol-delivery component according to claim 1 wherein the channel extends between a channel inlet and a channel outlet and the channel is unimpeded between the channel inlet and the channel outlet.

3. The aerosol-delivery component according to claim 1 wherein the channel is a transverse channel.

4. The aerosol-delivery component according to claim 1 wherein the component comprises an airflow path extending from an air inlet to an air outlet, the airflow path comprising an inlet portion extending from the air inlet to the vaporization chamber wherein the channel extends substantially perpendicularly to the inlet portion of the airflow path.

5. The aerosol-delivery component according to claim 4 wherein the airflow path comprises an outlet portion extending to the air outlet within a passage and wherein the channel extends substantially perpendicularly to the passage.

6. The aerosol-delivery component according to claim 1 wherein the channel extends substantially parallel to the cylindrical wick.

7. The aerosol-delivery component according to claim 6 wherein the channel is vertically/axially adjacent to one of the respective apertures in the first and second opposing chamber walls, in a downstream direction from the cylindrical wick.

8. The aerosol-delivery component according to claim 6 wherein the channel extends through the insert to the tank.

9. The aerosol-delivery component according to claim 8 wherein the insert comprises a lower portion and an upper portion and the channel is defined between a lower surface of the upper portion and the cylindrical wick.

10. The aerosol-delivery component according to claim 9 wherein an upper wall is defined by the upper portion of the insert, the upper wall having the semi-cylindrical profile.

11. The aerosol-delivery component according to claim 10 wherein the second diameter of the semi-cylindrical profile is between 3-7 mm.

12. The aerosol-delivery component according to claim 9 wherein the upper portion of the insert comprises at least one longitudinally-extending groove on a surface facing the tank and wherein the channel opens into the longitudinally-extending groove.

13. The aerosol-delivery component according to claim 1 which is a consumable component for receipt in a smoking substitute device.

14. An aerosol-delivery system comprising the aerosol-delivery component according to claim 1 and a device comprising a power source.

* * * * *